US005505360A

United States Patent [19]

Giusto

[11] Patent Number: 5,505,360

[45] Date of Patent: Apr. 9, 1996

[54] MOVABLE GRIPPING JAW WITH CONVEYOR SUPPORT FOR A WEB

[76] Inventor: Placido Giusto, Corso Moncalieri, 72-10133 Turin, Italy

[21] Appl. No.: 159,264

[22] Filed: Nov. 30, 1993

[51] Int. Cl.[6] ..... B65H 20/00

[52] U.S. Cl. ..... 226/150; 226/162

[58] Field of Search ..... 226/150, 149, 226/151, 139, 167, 162

[56] References Cited

U.S. PATENT DOCUMENTS

| | | | |
|---|---|---|---|
| 3,753,522 | 8/1973 | Voges | 226/141 |
| 4,059,212 | 11/1977 | Ledgerwood | 226/141 |
| 4,265,385 | 5/1981 | Hills | 226/127 |
| 4,513,899 | 4/1985 | Ledgerwood | 226/141 |
| 4,542,672 | 9/1985 | Pearl | 83/409 |
| 4,669,645 | 6/1987 | Nordlof | 226/134 |

*Primary Examiner*—Daniel P. Stodola

*Attorney, Agent, or Firm*—Sughrue, Mion, Zinn, Macpeak & Seas

[57] ABSTRACT

A feeding device for feeding thin and delicate web material towards a work station, particularly a forming press, includes a longitudinal support and guide member for the web and a step-feed assembly for feeding the web onto the support and guide member along a longitudinal direction. The feed assembly includes a stationary gripper and a movable gripper, and the longitudinal support and guide member for the web is a single endless belt having an upper bearing run situated under the web and above the movable jaws of the two grippers.

1 Claim, 3 Drawing Sheets

MOVABLE GRIPPING JAW WITH CONVEYOR SUPPORT FOR A WEB

BACKGROUND OF THE INVENTION

The present invention is generally related to the handling of continuous, thin and delicate webs of any material.

More particularly, the invention is directed to a feeding device for such webs towards a work station, particularly but not exclusively to a forming press, of the type comprising longitudinal support and guiding means of the web and step-feed means of the web onto said support and guide means along a longitudinal direction, wherein the feed means comprise a stationary gripper and a movable gripper each including a fixed jaw and a movable jaw placed transverse to and on opposite sides of the web, a pneumatic actuator assembly for operating linear alternative forward and back displacement of the movable gripper relative to the stationary gripper parallelly to said longitudinal direction and opening and closure of the movable jaws of said grippers relative to the respective fixed jaws in synchronism with the alternative displacement of the movable gripper, and an adjustable stop member cooperating with the movable gripper at the end of the forward displacement thereof.

Feeding devices of the above-mentioned type are currently manufactured and marketed by ELMER of Turin, Italy. Traditionally, in these known feeding devices the longitudinal support and guide means of the web between the jaws of the two grippers comprise a pair of superimposed endless upper and, respectively, lower belts, maintained in a stressed condition by respective pairs of rollers and having, respectively, a lower run and an upper run facing each other and between which the web material is longitudinally supported and guided. The web and the adjacent runs of the two endless belts are interposed between the fixed jaws and the movable jaws of the two grippers, and the disposition is such that the fixed jaws, along with the pneumatic actuator assembly and said adjustable stop member, are contained within the loop of the lower belt, while the movable jaws of the grippers are placed within the loop of the upper belt.

Evidently, the combined opening and closure movements of the movable jaws of the two grippers and the alternative synchronised displacement of the movable gripper produce translation of the two endless belts and the consequent step advancement of the web material inserted therebetween, along the longitudinal feed direction.

In order to modify the feed-step setting of the web it is sufficient to change the position of the adjustable stop member, increasing or decreasing the distance thereof relative to the stationary gripper.

However, owing to the above disposition, in the feeding devices presently known the step setting operation generally involves problems generated by difficult accessibility of the stop member.

SUMMARY OF THE INVENTION

The object of the present invention is to overcome the above drawback, and to provide a feeding device for web material of the type defined at the beginning, which is adapted to make the feed step setting operations easier and prompter.

A further object of the invention is to provide a feeding device for web material having a simplified construction.

Still another object of the invention is to provide a feeding device for web material of the above mentioned type, which is designed so as to effectively prevent, during the advancement phase, any risks of inflection or jamming of the web.

According to the invention, these and other objects are achieved essentially by virtue of the fact that the longitudinal support and guide means of the web comprise a single endless belt having an upper bearing run placed under the web and above the movable jaws of the two grippers.

With the disposition of the invention, the pneumatic actuator assembly and the adjustable stop member are conveniently situated above the web, i.e. above the upper bearing run of said single endless belt, and are thus immediately accessible from the outside so as to render extremely convenient and simple both the feed step setting and any maintenance operations of the pneumatic actuator assembly.

BRIEF DESCRIPTION OF THE DRAWINGS

The invention will now be disclosed in detail with reference to the accompanying drawings, purely provided by way of non-limiting example, in which.

DETAILED DESCRIPTION OF THE INVENTION

Figure 1:
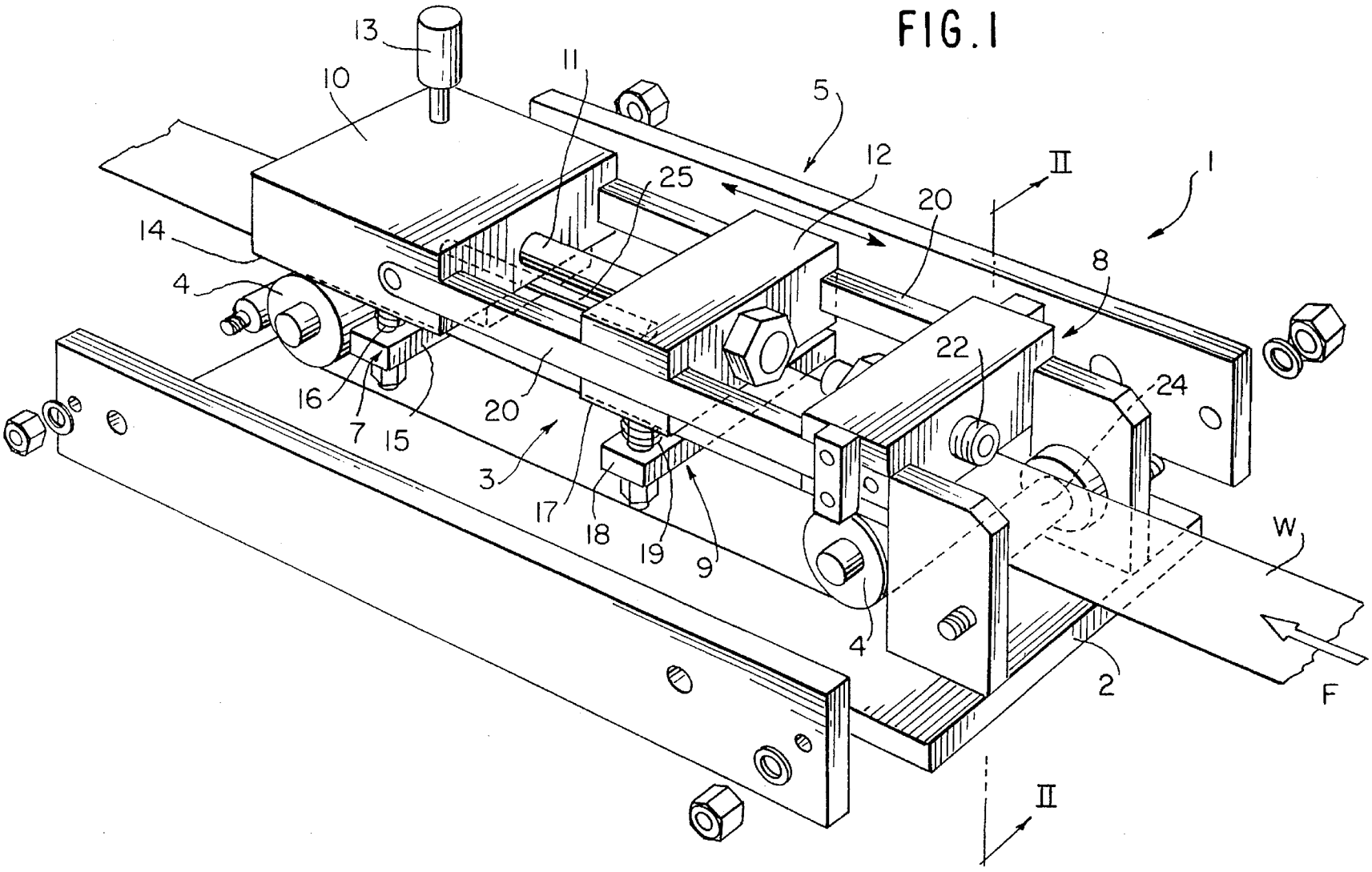
FIG. 1 is a diagrammatic perspective and partially exploded view of a feeding device for web material according to the invention.
Figure 2:
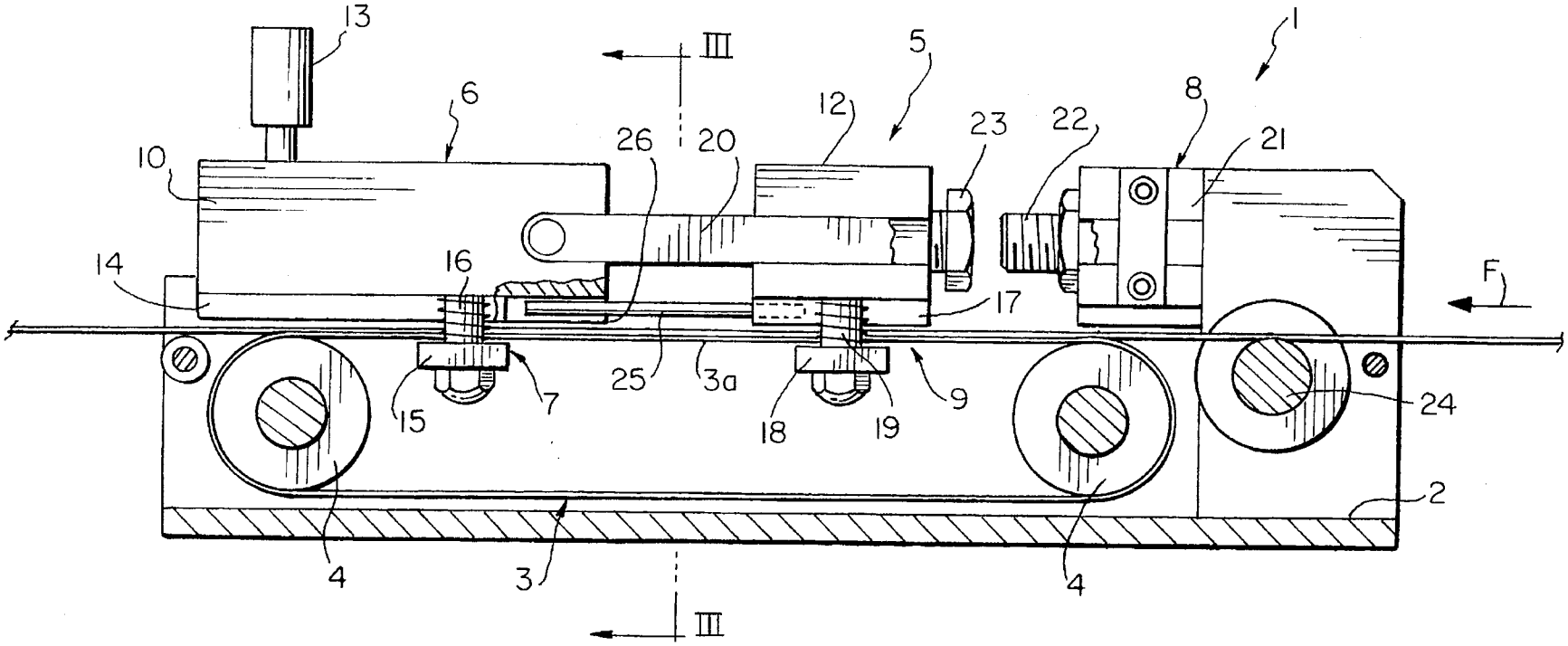
FIG. 2 is a longitudinal section view taken along line II—II of FIG. 1.
Figure 3:
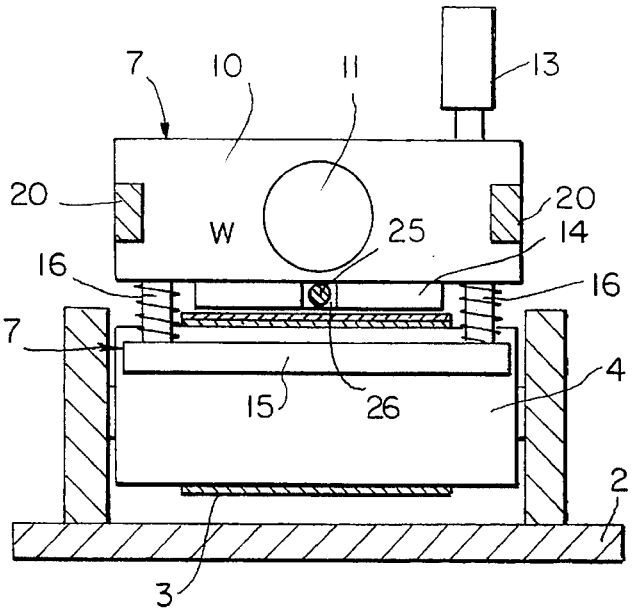
FIG. 3 is a partially cross section view taken along line III—III of FIG. 2, and FIGS. 4, 5 and 6 are diagrammatic views analogous to FIG. 2 and in a reduced scale, showing three successive operation phases of the feeding device according to the invention.

Referring initially to FIGS. 1 through 3, reference number 1 generally designates a feeding device for a continuous, thin and delicate web W, for instance of metal or plastic material or any other material, towards a work station not shown in the drawings, for example a forming press.

The feeding device 1 comprises a support structure 2 carrying in its lower part a single endless belt 3 maintained in a stressed condition between a pair of idle rollers 4, and bearing in its upper part a stepfeed assembly 5 of the web W along a longitudinal direction, indicated by arrow F.

The feed assembly 5 comprises, in a way generally known per se, a pneumatic actuator unit 6 to which a stationary gripper 7 is operatively associated, an adjustable stop member 8, and a movable gripper 9 interposed between the actuator unit 6, i.e. the stationary gripper 7, and the adjustable stop member 8. The actuator unit 6 comprises a body 10 containing in a way known per se, and for the sake of brevity not disclosed in detail, a linear pneumatic actuator assembly operating, by means of a valve assembly also generally known per se, so as to produce alternative forward and back displacement of the movable gripper 9. To such effect the stem of the linear pneumatic actuator, referenced as 11, projects centrally from the body 10 and is fixed to a block 12 carrying the movable gripper 9.

It is to be pointed out that, in the case of a feeding device for webs of larger sizes, two or even three pneumatic actuators with respective rods 11 can be employed for operating displacement of the movable gripper 9.

For operation of the pneumatic actuator it is provided in a known way, in the case of the shown example, a control valve 13 which in turn can be mechanically operated for instance by means of a mechanism associated to the forming press. Alternatively, a remote pneumatic or electropneumatic control system with associated cam device, also known per se, may be contemplated.

The stationary gripper 7 comprises a fixed jaw 14, which is in practice constituted by a slide plate formed at the bottom of the body 10 and placed above the horizontal upper run 3*a* of the belt 3, and a movable jaw 15 placed immediately under this upper run 3*a*. The movable jaw 15 is formed by a horizontal transverse element, oriented perpendicularly to the advancement direction F, and connected in proximity of its ends to a pair of linear pneumatic actuators known per se, carried by the body 10 and the stems of which are referenced as 16.

The movable jaw 15 is vertically displaceable with respect to the fixed jaw 14 between a lowered open position and a raised closed position of the stationary gripper 7, as will be clarified in the following.

Likewise, the movable gripper 9 comprises a fixed jaw 17, defined by a slide plate formed at the base of the block 12, and a movable jaw 18, analogous to the movable jaw 15 of the stationary gripper 7 and vertically displaceable between a lowered open position and a raised closed position relative to the fixed jaw 17, by means of a pair of linear pneumatic actuators known per se, carried by the block 12 and the stems of which are indicated as 19.

The block 12, which as explained is connected to the stem 11, is linearly and alternatively displaceable along a pair of lateral guide elements 20, to the ends of which opposite to the actuator unit 6 is adjustably secured the stop member 8. The stop member 8 comprises a transverse block 21 carrying centrally at least one adjustable screw stopper 22, which is intended to cooperate with at least a corresponding damper stop 23 correspondingly carried by the block 12 of the movable gripper 9.

At the outlet of the actuator assembly 5, the support structure 2 is further provided with one or more transverse guide rollers 24.

Reference 25 designates a rod, directed parallel to the longitudinal feed direction F, which is fixed at one end centrally to the side of the fixed jaw 17 facing towards the actuator unit 6, and whose opposite end is slidably coupled within a corresponding longitudinal groove 26 of the fixed jaw 14 of the stationary gripper 7.

In operation, the web material W to be step-fed is laid onto the upper run 3*a* of the single endless belt 3, and is thus positioned immediately beneath the fixed jaws 14 and 17 of the stationary gripper 7 and of the movable gripper 9, respectively. The whole feed assembly 5 is therefore situated, with the only exception of the movable jaws 15 and 18, above the belt 3 bearing the web W.

Figure 4:
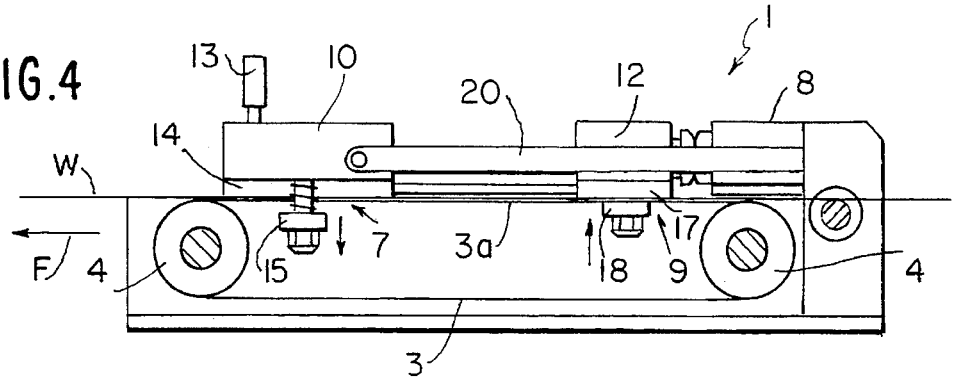
Figure 5:
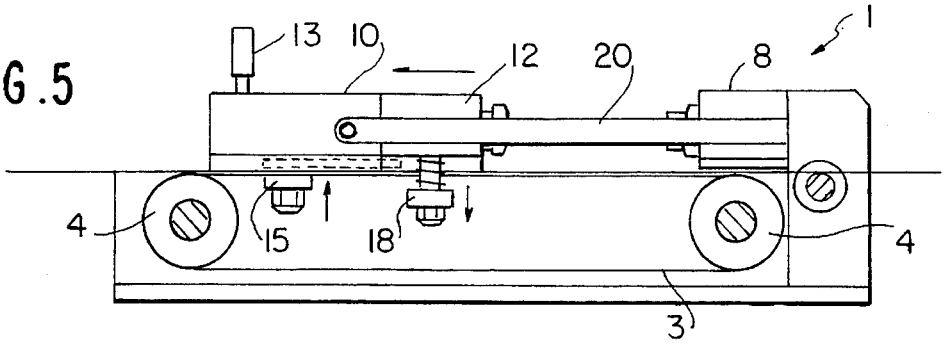
Figure 6:
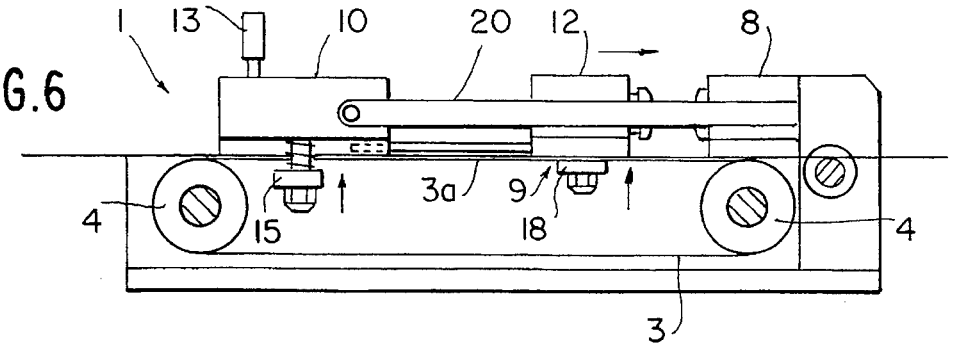

FIGS. 4 through 6 show diagrammatically the successive step advancement phases of the web W in the longitudinal direction F, assuming to start from the position in which the movable gripper 9 is placed against the stop member 8.

In the first phase (FIG. 4) the stationary gripper 7 is open and the movable gripper 9 is closed, so as to grip the corresponding portions of the upper run 3*a* of the belt 3 and of the web W against the fixed jaw 17. Displacement of the movable gripper 9 from the stop member 8 towards the body 10 of the actuator unit 6 thus produces the advancement of the web W in the F direction, for a length corresponding to the step previously set by the positioning of the body 21 and adjustment of the screw stopper 22.

At the end of the feeding stroke (toward left with reference to the drawings), i.e. as soon as the block 12 of the movable gripper abutts against the body 10, the stationary gripper 7 is closed and the movable gripper 9 is opened (FIG. 5), thus enabling backward displacement of the latter to the start position (toward right with reference to the drawings), while the web W remains stationary (FIG. 6).

As soon as the movable gripper 9 stops against the stop member 8, the stationary gripper 7 is re-opened and the movable gripper 9 is again closed, and the feeding cycle of the web W is then identically repeated (FIG. 4).

It will be apparent from the above that the conformation of the feeding device 1 according to the invention, with a single endless belt 3 placed underneath the web W, and with the whole feed assembly 5 (but for the movable jaws 15 and 18 of the grippers 7 and 9) situated above the web W, enables performing adjustment of the feed step in an extremely convenient and quick way, since the stop member 8 with the adjustment screw 22 is easily and immediately accessible from the outside.

Moreover, any maintenance operations of the actuator unit 6 or of other components of the feed assembly 5 are likewise made simple and convenient. Lastly, the presence of the rod 25, which as explained is extending longitudinally between the fixed jaws 14 and 17, effectively prevents, during forward displacement of the web W, any inflection or jamming of the web W. Obviously, to such effect two or more rods 25 can possibly be employed.

What I claim is:

1. A feed device for feeding a thin and delicate web material to a work station comprising longitudinal support and guide means for supporting and guiding the web and step-feed means for feeding the web onto said support and guide means along a longitudinal direction, wherein said step feed means comprises a stationary gripper and a movable gripper each including a fixed jaw and a movable jaw placed transverse to and on opposite sides of the web, a pneumatic actuator assembly for operating linear alternative forward and back displacement of the movable gripper relative to the stationary gripper parallel to said longitudinal direction and for opening and closing of the movable jaws of said grippers relative to the respective fixed jaws in synchronism with the alternative displacement of the movable gripper, and an adjustable stop member cooperating with the movable gripper at the end of the forward displacement thereof, wherein the longitudinal support and guide means of the web comprises a single endless belt having an upper bearing run placed under the web and above the movable jaws of the two grippers, said endless belt being movable by said movable gripper when gripped with said web between said fixed jaw and said movable jaw of said movable gripper, wherein the pneumatic actuator assembly and the adjustable stop member are situated above the upper bearing run of said single endless belt and wherein the fixed jaws of the two grippers define respective slide plates above the web, said feed device further comprising at least one rod extending between said slide plates parallel to said longitudinal feed direction of the web and situated immediately above the web, said at least one rod being fixedly secured to the slide plate of the movable gripper and being slidably coupled in a corresponding groove of the slide plate of the stationary gripper for preventing any inflection or jamming of the web during forward displacement of the web.

* * * * *